United States Patent [19]

Strickland

[11] 4,374,589

[45] Feb. 22, 1983

[54] HANDLE FOR TENNIS RACKET WITH ANTI-TORSION GRIP PORTION

[76] Inventor: Gordon E. Strickland, 434 Guinda St., Palo Alto, Calif. 94301

[21] Appl. No.: 124,438

[22] Filed: Feb. 25, 1980

Related U.S. Application Data

[60] Continuation of Ser. No. 934,944, Aug. 18, 1978, abandoned, which is a division of Ser. No. 795,195, May 9, 1977, Pat. No. 4,149,721.

[51] Int. Cl.[3] ..... A63B 49/08

[52] U.S. Cl. ..... 273/75

[58] Field of Search ..... 273/67 R, 67 A, 67 DA, 273/73 J, 75, 76, 81 R, 81 B, 81.4, 81.5, 81.6; 145/61 R, 61 C

[56] References Cited

U.S. PATENT DOCUMENTS

| | | | |
|---|---|---|---|
| 1,828,109 | 10/1931 | Fox | 273/73 J |
| 2,655,963 | 10/1953 | Dell | 273/75 X |
| 3,203,697 | 8/1965 | Berzatzy | 273/75 |
| 3,664,668 | 5/1972 | Held | 273/75 X |
| 4,072,312 | 2/1978 | Kahn | 273/75 |

FOREIGN PATENT DOCUMENTS

| | | | |
|---|---|---|---|
| 5457 | of 1884 | United Kingdom | 273/67 DA |
| 389353 | 3/1933 | United Kingdom . | |
| 409325 | 4/1934 | United Kingdom | 273/81 B |
| 735318 | 8/1955 | United Kingdom . | |
| 767320 | 1/1957 | United Kingdom . | |
| 776504 | 6/1957 | United Kingdom . | |
| 1122895 | 8/1968 | United Kingdom . | |
| 1304015 | 1/1973 | United Kingdom . | |

*Primary Examiner*—Anton O. Oechsle

*Attorney, Agent, or Firm*—Phillips, Moore, Lempio & Finley

[57] ABSTRACT

The grip portion of a tennis racket comprises a pair of flat surfaces disposed in parallel relationship relative to each other and relative to a flat plane containing the head of the racket. Each of the flat surfaces is subtended by an obtuse angle having its vertex at a geometric center of the grip portion. A pair of at least substantially arcuate surfaces are each subtended by an acute angle and intersect the flat surfaces to define four perceptible edges about the grip portion, with each of the arcuate surfaces being defined by a radius having its center at the geometric center of the grip portion and further having a length of about 0.75 inches.

4 Claims, 2 Drawing Figures

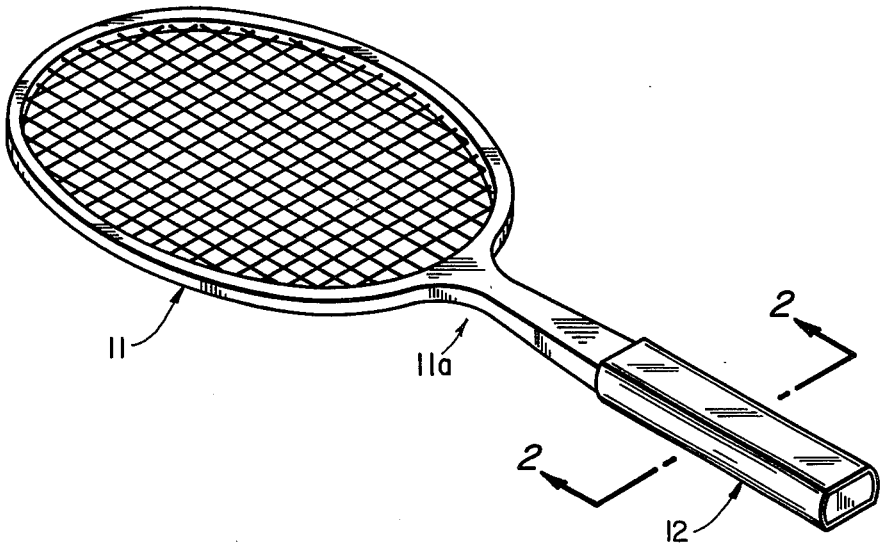
FIG__1
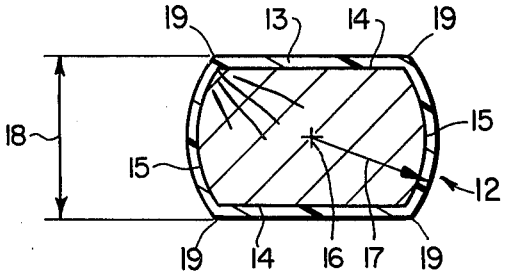
FIG__2

HANDLE FOR TENNIS RACKET WITH ANTI-TORSION GRIP PORTION

CROSS REFERENCE TO RELATED APPLICATIONS

This is a continuation of application Ser. No. 934,944, filed on Aug. 18, 1978 and now abandoned, the latter application being a division of application Ser. No. 795,195, filed on May 9, 1977, and now U.S. Pat. No. 4,149,721.

TECHNICAL FIELD

This invention relates to a grip portion formed on a handle of a tennis racket.

BACKGROUND ART

The grip portion of a standard tennis racket normally has an octagonal cross-section which poses misalignment problems when a tennis player shifts his hand position for different strokes. The proper orientation of the player's hand on the racket is, of course, necessary for effecting the desired stroke correctly. Reorientation of the player's hand must be accomplished rapidly during play and is primarily effected by a sense of feel. For example, as many as five different grips may be required during play to properly orient the head of the racket. For example, separate grips may be required for a forehand shot, a backhand shot, shortened versions of each of the forehand and backhand volleys at the net, and for serving and overhead smashes.

Such required accuracy of grip position is exemplified by a shot requiring a low, flat drive from the baseline of a tennis court. In order to properly effect such a shot, it is desirable to achieve a low trajectory of the tennis ball with considerable velocity whereby the ball will clear the net by only approximately three inches. Even the slightest error or misalignment of the player's grip on the grip portion of the racket's handle may allow the handle to rotate in the player's hand about 1/32 of an inch or 2° from the correct position, resulting in the ball being hit 18 to 20 inches above or below the top of the net.

Obviously, such misalignment can occur either by the player gripping the standard grip portion of the handle improperly or by the string portion of the racket being impacted off-center and under considerable force by a tennis ball, which tends to apply torque to the racket which is difficult to resist by the hand of the player.

DISCLOSURE OF INVENTION

This invention provides a revolutionary grip portion for the handle of a tennis racket that will not only permit a player to rapidly and accurately change his grip by feel, but that will also resist torque loads imposed on the racket upon its impact with a tennis ball.

The tennis racket comprises a head lying in a flat plane and a handle having a grip portion attached to the head by a neck portion. The improved grip portion comprises a pair of flat surfaces disposed in parallel relationship relative to each other and to the plane of the head, with each of the flat surfaces being subtended by an obtuse angle having its vertex at the geometric center of the grip portion, and a pair of at least substantially arcuate surfaces disposed transversely relative to the flat surfaces and the plane of the head. Each of the arcuate surfaces are subtended by an acute angle having its vertex at the geometric center of the grip portion and intersecting each of the flat surfaces to define perceptible edges at the junctures thereof with each of the arcuate surfaces being defined by a radius having its center at the geometric center of the grip portion and having a length of about 0.75 in.

The improved grip portion will thus afford a natural perception of the orientation of the surfaces thereof to induce a more precise alignment of the natural plane sensed by the grip of a player's hand and the actual physical plane of the racket head or face. In addition, the grip portion of this invention will produce a more secure grip offering torsional resistance to induced rotation of the racket in a player's hand upon its impact with a tennis ball, such, rotation normally causing imprecision of alignment and consequent error in play.

The desired effect of the grip portion of this invention may be readily appreciated by comparing it with the standard grip portion formed on most commercially available rackets. Such conventional grip portions generally approach a square with beveled or chamfered edges with the resultant shape being an irregular octagon. The flat surfaces defined on the grip portion of this invention are perceptibly wider than those formed on a standard grip portion, and since there are only two flat surfaces, orientation of the face of the racket may be readily ascertained by feel.

Thus, the wider flat surfaces formed on the grip portion of this invention provide an immediate and heightened perception of the racket face alignment, afford greater accuracy of control, and facilitate a more natural application of force to the racket by the player due to the greater bearing surfaces provided for the hand. The dimensional relationship between the flat and arcuate surfaces on the grip portion conform naturally to the bending pattern of the phalangeal bones of the fingers as they form the grip of the hand, thus resulting in a more secure grip than is normally provided by conventional tennis racket grips. Furthermore, the perceptible edges formed on the grip portion cooperate with the flat and arcuate surfaces thereof to provide an arcuate grip allowing a more natural application of greater force to the racket and a grip that is more secure against the effects of an off-center force (such as from hitting the ball off-center, or striking the ground with the racket) which would produce a torque tending to rotate the racket in the hand of a player, resulting in playing errors. Also, the grip portion facilitates very rapid changes in the relative orientation of the hand on the grip portion during play.

BRIEF DESCRIPTION OF THE DRAWING

Other advantages and objects of this invention will become apparent from the following description and accompanying drawing wherein;

FIG. 1 is an isometric view of a tennis racket employing the grip portion of the present invention thereon; and FIG. 2 is a cross-sectional view through the grip portion, taken in the direction of arrows 2—2 in FIG. 1.

BEST MODE OF CARRYING OUT THE INVENTION

FIG. 1 illustrates a tennis racket comprising a strung head 11 having a grip portion 12 of a handle connected to the head by a neck portion. A resilient covering sleeve 13 may be secured on grip portion 12 of the racket as more fully disclosed in applicant's parent U.S. Pat. No. 4,149,721.

FIG. 2 illustrates the geometric shape of grip portion 12 as comprising a pair of flat surfaces 14 disposed in parallel relationship relative to each other and to the flat plane in which the head of the racket lies. A pair of at least substantially arcuate surfaces 15 are disposed transversely relative to flat surfaces 14 and the flat plane containing the head of the racket. Flat surfaces 14 are subtended by an obtuse angle having its vertex at a geometric center 16 of grip portion 12 with the center further denoting the center of symmetry of the grip portion. Each arcuate surface intersects each flat surface at a perceptible edge 19.

In practice, it is desirable that the perimeter of grip portion 12 be such that it may be encircled by a loop made by touching the tips of the thumb and index finger of a player's hand. For an average sized hand, this perimetric length should be about 4.5 inches with a variation in production to allow for the natural human variation and hand size. It should be further noted in FIG. 2 that arcuate surfaces 15 are each subtended by an acute angle having its vertex at geometric center 16. Each arcuate surface 15 is defined by a radius 17 having its center at geometric center 16 and, further, having a length of about 0.75 in.

The fundamental design concept of grip portion 12 rests upon formation of arcuate surfaces 15 as portions of a cylinder of radius 17 intersecting flat surfaces 14 (geometrically chords of the circle in cross-section) so at edges 19 that the central angle at the center of symmetry 16 subtended by each flat planar surface 14 is greater than 90°, while the angle subtended by each substantially arcuate surface 15 is less than 90°. FIG. 2 illustrates a configuration for grip portion 12 with some degree of accentuation for clarity, representing the feasible limit of how wide the flat surfaces 14 can be made at the perimetric handle size of about 4.5 inches. As shown, radius 17 approximates 0.75 inches to produce flat surfaces approximating 1.25 inches wide with a distance 18 between the flat surfaces being about 0.9375 in. The angles, in this case, are about 110° subtended by surfaces 14 and 70° subtended by surfaces 15.

Having described the preferred embodiment of my invention above, it should be clear that within these perameters minor variations may be made without departing from what is claimed:

1. In a tennis racket having a head lying in a flat plane, and a handle having a grip portion attached to said head by a neck portion, said grip portion having a geometric center when viewed in cross section, the improvement wherein said grip portion comprises a pair of flat surfaces disposed in parallel relationship relative to each other and to said plane, each of said flat surfaces being subtended by an obtuse angle having its vertex at said geometric center, and a pair of at least substantially arcuate surfaces disposed transversely relative to said flat surfaces and said plane with each of said arcuate surfaces being subtended by an acute angle having its vertex at said geometric center and intersecting each of said flat surfaces to define a perceptible edge at the juncture thereof, each of said arcuate surfaces being defined by a radius having its center at said geometric center and having a length of about 0.75 inches.

2. The racket of claim 1 wherein said obtuse angle is about 110° and said acute angle is about 70°.

3. The racket of claim 1 wherein each of said flat surfaces has a width approximately 1.25 inches and wherein the distance between said flat surfaces is about 0.9375 inches, when said handle is viewed in cross section.

4. The racket of claim 1 wherein the perimetric length of said grip portion is substantially about 4.5 inches throughout the length thereof.

* * * * *